United States Patent [19]

Speer

[11] 4,426,910

[45] Jan. 24, 1984

[54] MAN-PORTABLE FOLDABLE LAUNCHER ROCKET WEAPON SYSTEM

[75] Inventor: Spencer J. Speer, Ontario, Calif.

[73] Assignee: General Dynamics, Pomona, Calif.

[21] Appl. No.: 331,493

[22] Filed: Dec. 17, 1981

[51] Int. Cl.[3] ..... F41F 3/04

[52] U.S. Cl. ..... 89/1.816; 224/911

[58] Field of Search ..... 89/1.816, 1.817, 1.812, 89/1.813, 1.814, 1.8, 1.7; 42/77; 224/911

[56] References Cited

U.S. PATENT DOCUMENTS

| | | | |
|---|---|---|---|
| 2,344,957 | 3/1944 | Anzalone | 89/1.816 |
| 2,421,752 | 6/1947 | Jones | 89/1.816 |
| 2,972,933 | 2/1961 | Guthrie | 89/1.817 |
| 3,113,796 | 12/1963 | Neil | 224/911 X |
| 3,118,580 | 1/1964 | Manshel | 224/911 X |
| 3,122,059 | 7/1964 | Choate et al. | 89/1.813 |
| 3,401,597 | 9/1968 | Comte et al. | 89/1.816 X |
| 3,490,330 | 1/1970 | Walther | 89/1.7 |
| 3,718,070 | 2/1973 | Schneider | 89/1.813 X |
| 3,745,876 | 7/1973 | Rocha | 89/1.7 |
| 3,750,529 | 8/1973 | Reed et al. | 89/1.817 X |
| 3,780,616 | 12/1973 | Rusbach | 89/1.814 X |
| 3,960,054 | 6/1976 | Looger | 89/1.816 |
| 3,961,556 | 6/1976 | Clodfelter | 89/1.816 |
| 3,999,460 | 12/1976 | Skliris | 89/1.816 |
| 4,203,347 | 5/1980 | Pinson et al. | 89/1.816 |

*Primary Examiner*—David H. Brown

*Attorney, Agent, or Firm*—Neil F. Martin; John R. Lindsay; Edward B. Johnson

[57] ABSTRACT

A man portable shoulder fired rocket weapon system including a two section tubular launcher, sections of which are hingedly foldable one over the other to reduce the launcher length for storage and transport, and permitting the launcher to be holster carried in the manner of a sidearm. A lock and seal coupling connects the unfolded launcher tube sections to extend the launcher for firing and also serves as a safety element in the firing circuit. Two tubular blast shields are mounted concentrically upon the launch tube sections and are extendable therefrom to further lengthen the launcher and provide protection for the user against rocket motor exhaust. A compatible rocket round is carried in the folded launcher as a ready round. A waist worn holster and reload pack complete the weapon system elements.

8 Claims, 14 Drawing Figures

MAN-PORTABLE FOLDABLE LAUNCHER ROCKET WEAPON SYSTEM

BACKGROUND OF THE INVENTION

There is a continuing need to increase the fire power availability to individual combat troops to provide strike and defense weapons against targets including armored vehicles, fortified positions, and opposing personnel. To fit such needs, the weapon system must be easily carried and handled, be rugged, and have warhead versatility. Known fin stabilized rockets have provided such a capability to a degree, in that rockets and launchers have been developed that are capable of being used by an individual soldier. However, available rocket weapon systems are designed for longer ranges and utilize rigid launching tubes which are of such length that they must at best be shoulder carried, and are relatively awkward to handle and fire. Additionally, presently available rocket weapon systems are generally not reusable after having once been fired.

It is desired therefore, to have a reloadable rocket weapon system that is usable at ranges to approximately 100 meters that may be easily carried and fired by an individual. Such a weapon system should be safe, compact, simple, and rugged so as to remain serviceable under combat conditions. The weapon system of the present invention fulfills these requirements.

SUMMARY OF THE INVENTION

According to the invention, a short range man portable rocket weapon system has been devised wherein the rocket launcher consists of forward and after tube sections that are foldable one upon the other for compactness such that the launcher may be holster carried at the belt of the user. Tubular blast shields concentrically mounted upon the launch tube sections are sealably extendable therefrom to provide additional launcher tube length and provide blast protection during rocket firing. According to a further precept of the invention, the unfolded sections are locked and sealed together by a coupling mechanism which also functions as an element in the electrical firing circuit of the launcher. The rocket launcher is reloadable with compatibly sized and configured rocket rounds. According to the illustrated embodiment, various rocket warhead designs may be made available to provide characteristics suitable against different targets such as vehicles, fortifications, or personnel. A belt carried reload pack of rocket rounds permits warhead selection and a sustained capability in the field.

It is an object of the invention to provide a new and improved short range rocket weapon system. The rocket launcher of the system is light in weight, yet rugged and safe. The launcher is foldable to provide a compact assembly which may be belt carried. The launcher is of simple design and is easily extended for shoulder firing. The launcher is reloadable. It is also relatively inexpensive to manufacture.

Other objects and many attendant advantages of the invention will become more apparent upon a reading of the following detailed description together with the drawings, in which like reference numerals refer to like parts throughout, and in which.

DETAILED DESCRIPTION OF THE DRAWINGS

Figure 1:
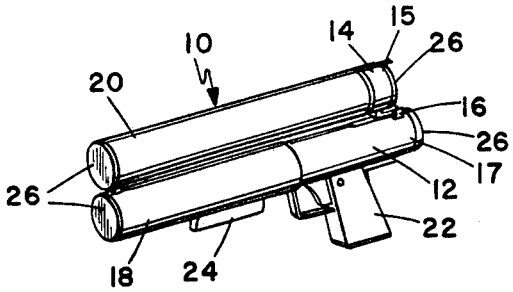
FIG. 1 is a perspective view of the rocket launcher in its folded configuration.
Figure 2:
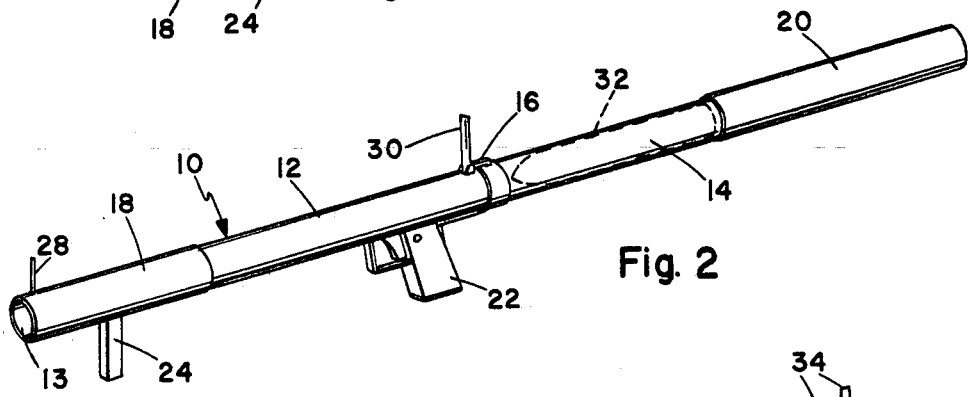
FIG. 2 is a perspective view of the rocket launcher in its extended configuration ready for firing.

The rocket launcher 10 is illustrated in its folded, or carrying configuration, in FIG. 1, and in its extended, of firing configuration, in FIG. 2. In the description that follows, forward refers to the muzzle end 13 of the extended launcher. Launcher 10 consists of a forward launch tube section 12 and an after launch tube section 14. The tube sections 12 and 14 are formed from metal tubing material such as steel or aluminum, but it is recognized that other suitable materials may be used. The launch tube sections 12 and 14 are rotatably connected together by hinge 16 such that the after tube section 14 may be folded forward to rest on top of the forward launch tube section 12, or rotated aft to form a rearward extension of the forward launch tube section 12 as illustrated in FIG. 2. A forward blast shield 18 is mounted concentric with, and slideable upon, the forward launch tube section 12. An after blast shield 20 is similarly formed and mounted upon the after launch tube section 14. A pistol grip 22 used in handling, aiming, and firing the rocket launcher 10 is attached adjacent to the after end of the forward launch tube section 12. A rotatable hand grip 24 is mounted to the under side of the forward blast shield 18. Caps 26 are employed to close the open ends of the launch tube sections 12 and 14 and are removed before firing of the rocket launcher.

Launcher 10 is illustrated in its shoulder firing configuration in FIG. 2. The after launch tube section 14 is depicted as having been rotated about hinge 16, and its forward end 15 sealed and locked against the after end 17 of the launch tube section 12 in a manner as will be subsequently described. Blast shields 18 and 20 are illustrated as extended forward and aft respectively to form an extended launcher 10 to guide the rocket during launching and limit blast effects. Handgrip 24 is shown rotated forward and locked to provide a hand hold for steadying the launcher 10 during aiming and firing. Front sight 28 and read side 30 are pivotally mounted to the forward blast shield 18 and the forward launch tube section 12, respectively, so that they may be lowered to fit between the launch tubes when the launcher 10 is folded.

Figure 3:
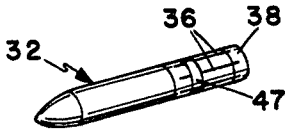
FIG. 3 is a pictorial view of the fin stabilized rocket used in the weapon system illustrating its pre-launch configuration.
Figure 4:
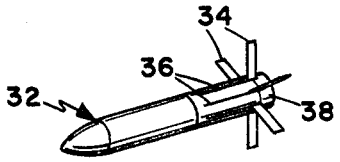
FIG. 4 illustrates the rocket of FIG. 3 with stabilizing fins deployed.
Figure 9:
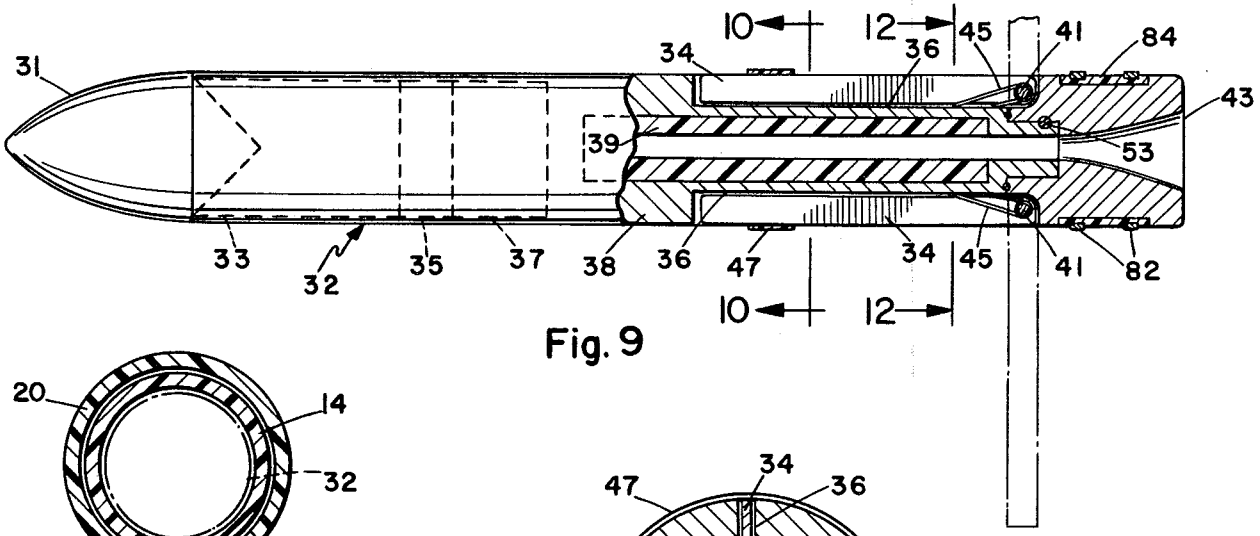
FIG. 9 is a side elevation view, partially cut away, of a typical rocket configuration for use in the weapon system.
Figure 10:
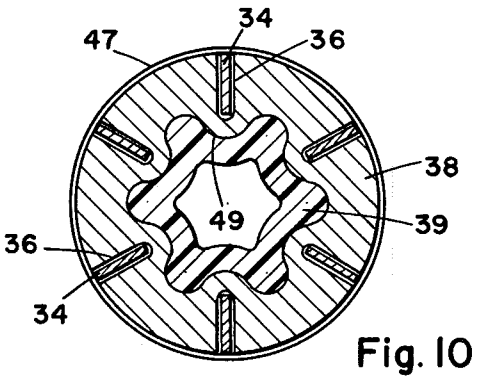
FIG. 10 is an enlarged sectional view taken on line 10—10 of FIG. 9.

The exterior configuration of a typical rocket 32 before firing is depicted in FIG. 3. Folding fins 34, (FIG. 4) for stabilizing the flight of the rocket 32 are folded into slots 36 in the rocket motor casing 38. In FIG. 4, a rocket 32 is illustrated in its after firing condition with the stabilizing fins 34 deployed. The construction of a representative rocket round 32 is illustrated in FIGS. 9 and 10. The rocket 32 has a nose cone 31, warhead section 33, detonator booster 35, fusing section 37, and a solid fuel propulsion motor 39. The warhead of the illustrated embodiment is a shaped charge, but it should be recognized that other warheads may be provided.

Figure 12:
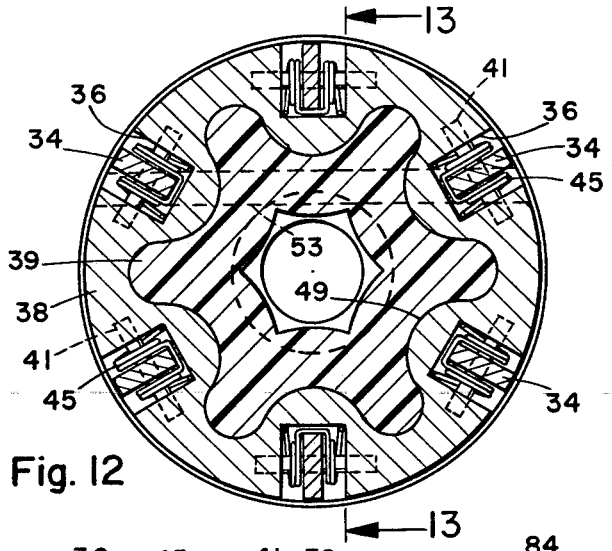
FIG. 12 is a sectional view taken on line 12—12 of FIG. 9 illustrating the deployable fin assembly.
Figure 13:
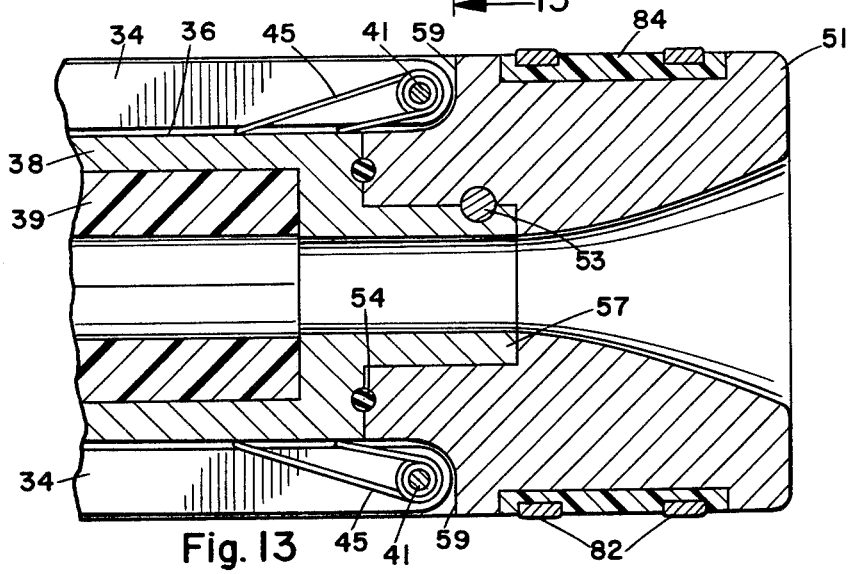
FIG. 13 is a sectional view taken on line 13—13 of FIG. 12.

As depicted in FIGS. 9 and 10, and illustrated in greater detail in FIGS. 12 and 13, the casing 38 of propulsion motor 39 is formed with longitudinal slots 36 which extend inwardly toward the inner surface 49 of the casing 38. The rocket nozzle end cap 51 slips over a stub 57 of the rocket motor casing 38 and is secured thereto by the retaining pin 53 which passes laterally through the end cap 51 and motor casing 38. An "O" ring 54 forms a seal between the nozzle end cap and the motor casing. End cap 51 is also formed with slots 59 which mate with and form extensions of the motor casing slots 36. The fins 34 are pivotally mounted on pins 41 which are installed in slots 59 of the nozzle end cap 51. In the pre-fire condition, fins 34 are contained within the slots 36 and 59 against the spring pressure exerted by springs 45. The fins are held in place by retainer band 47 until the rocket 32 is loaded.

Figure 14:
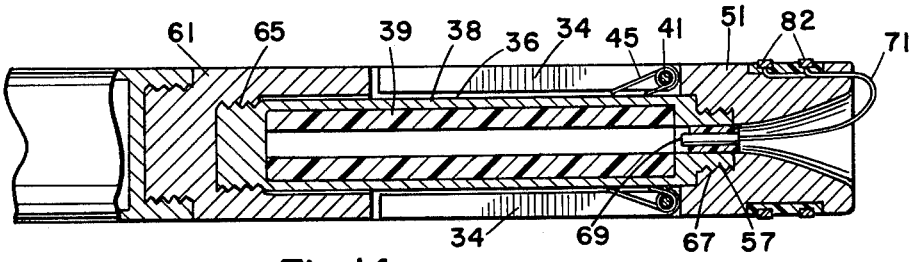
FIG. 14 is a view similar to FIG. 9, showing an alternate embodiment in which the rocket motor is joined by threaded connections.

FIG. 14 illustrates a second embodiment of the rocket 32 which has an alternate design for the assembly of the rocket motor casing 38. In this embodiment, the rocket motor casing 38 is joined to the rocket warhead body 61 by a threaded connection 65. The stub 57 at the after end of the motor casing is provided with a threaded section 67. Mating internal threads in the nozzle and end cap 51 are employed to secure the nozzle end cap to the stub 57. In the embodiment depicted in FIG. 14, a motor igniter 69 is located at the after end of the motor casing 38 which is connected by wiring leads 71 to the firing circuit connections 82.

Figure 5:
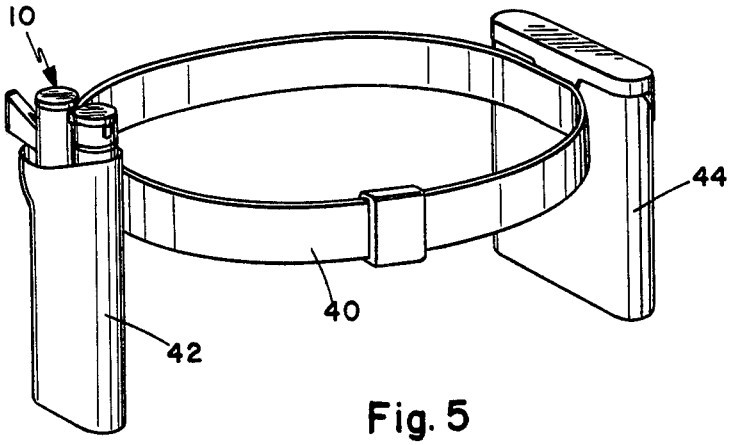
FIG. 5 is a pictorial view of the support components of the weapon system wearable by a combat soldier, and illustrating the rocket launcher of FIG. 1 within its holster.

The additional components of the weapon system are depicted in FIG. 5. A waist belt 40 of conventional design supports the launcher holster 42 and a reload rocket carrying pack 44. Carrying pack 44 is capable of storing 4 reload rockets. Launcher 10 is storable within the holster 40. By virtue of the design, the weapon system embodiment is not only easily man portable, but provides for a significant degree of sustained use in combat, since launcher 10 may be reloaded in the field with rockets contained in the carrying pack 44. It should be recognized, that the representative rocket round 32 may be equipped with warheads of different capabilities such that selection of a suitable round may be made by the combat soldier depending upon the targets anticipated or encountered.

Figure 6:
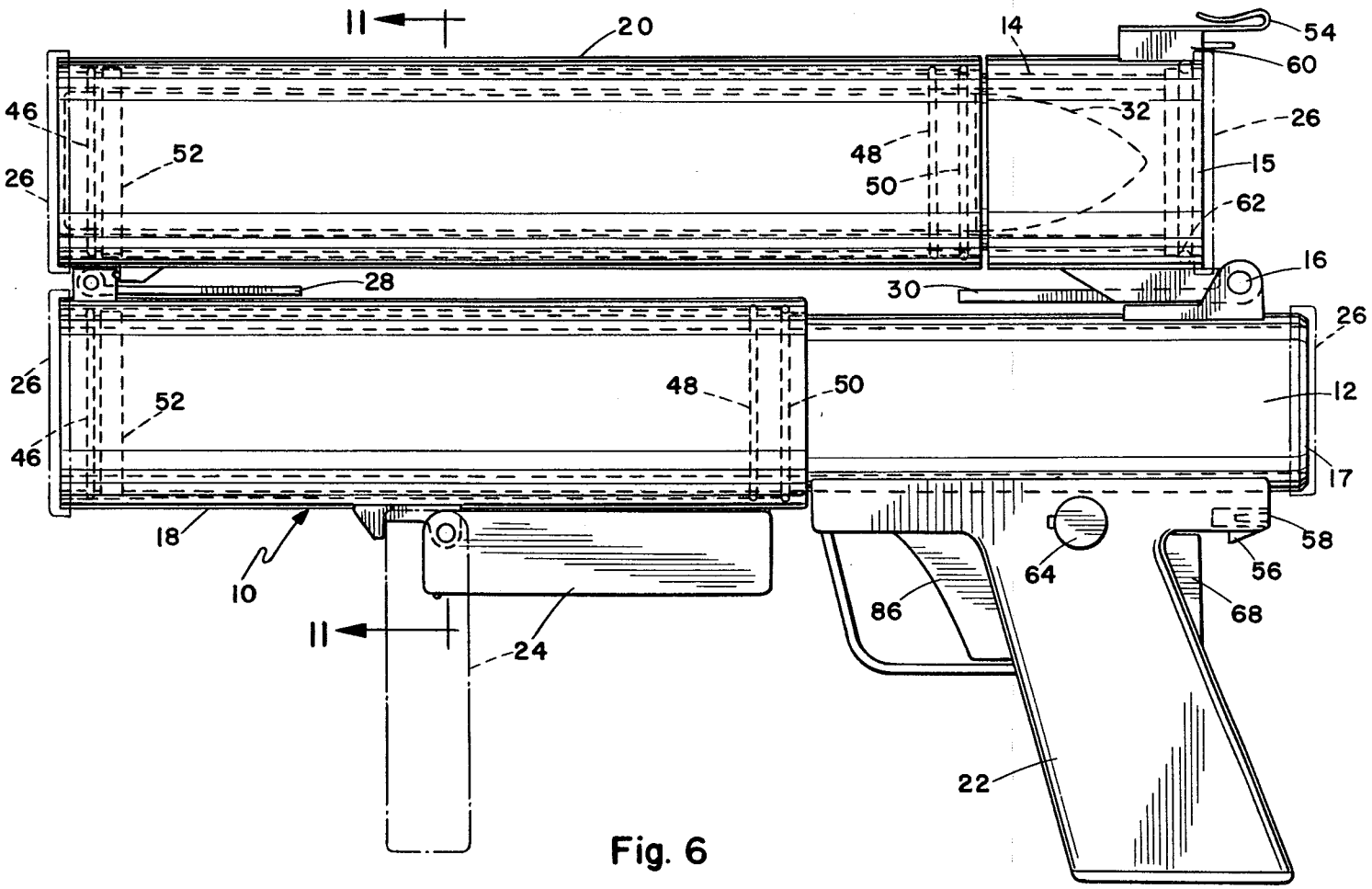
FIG. 6 is a side elevation view of the folded rocket launcher of FIG. 1.
Figure 11:
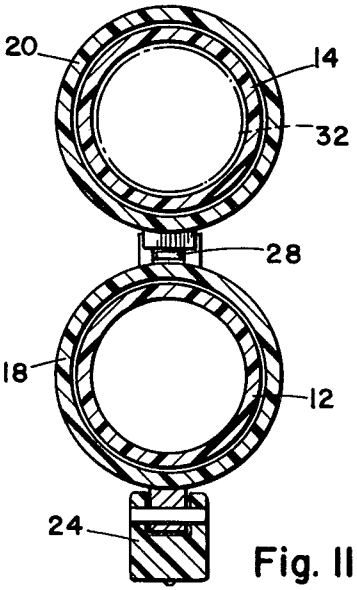
FIG. 11 is a sectional view taken on line 11—11 of FIG. 6.

Further details of the construction of rocket launcher 10 are illustrated in FIGS. 6 and 11, wherein the launcher 10 is shown in its folded configuration with a loaded round 32 in place in the after launch tube section 14. Since the arrangement, operation, and sealing of the blast shields 18 and 20 are the same, only the details of the forward shield 18 will be described. Blast shield 18 is tubular in shape, fits concentrically about a portion of the forward launch tube section 12, and is slideable thereon. Blast shield 18 is extendable forwardly on the launch tube section 12. When fully extended, as in FIG. 7, detents 46 located in and adjacent to the forward end of forward launch tube section 12 engage locking groove 48 located adjacent to the after end of the forward blast shield 18. The detents 46 and groove 48 are spaced so as to provide a sufficient overlap between blast shield 18 and launch tube section 12 for rigidity in the extended launcher 10. When blast shield 18 is extended, the "O" ring 50, located in the interior after end of blast shield 18 forms a seal with the seal flange 52 to provide a gas tight seal between the forward launch tube section 12 and the extended forward blast shield 18.

Figure 7:
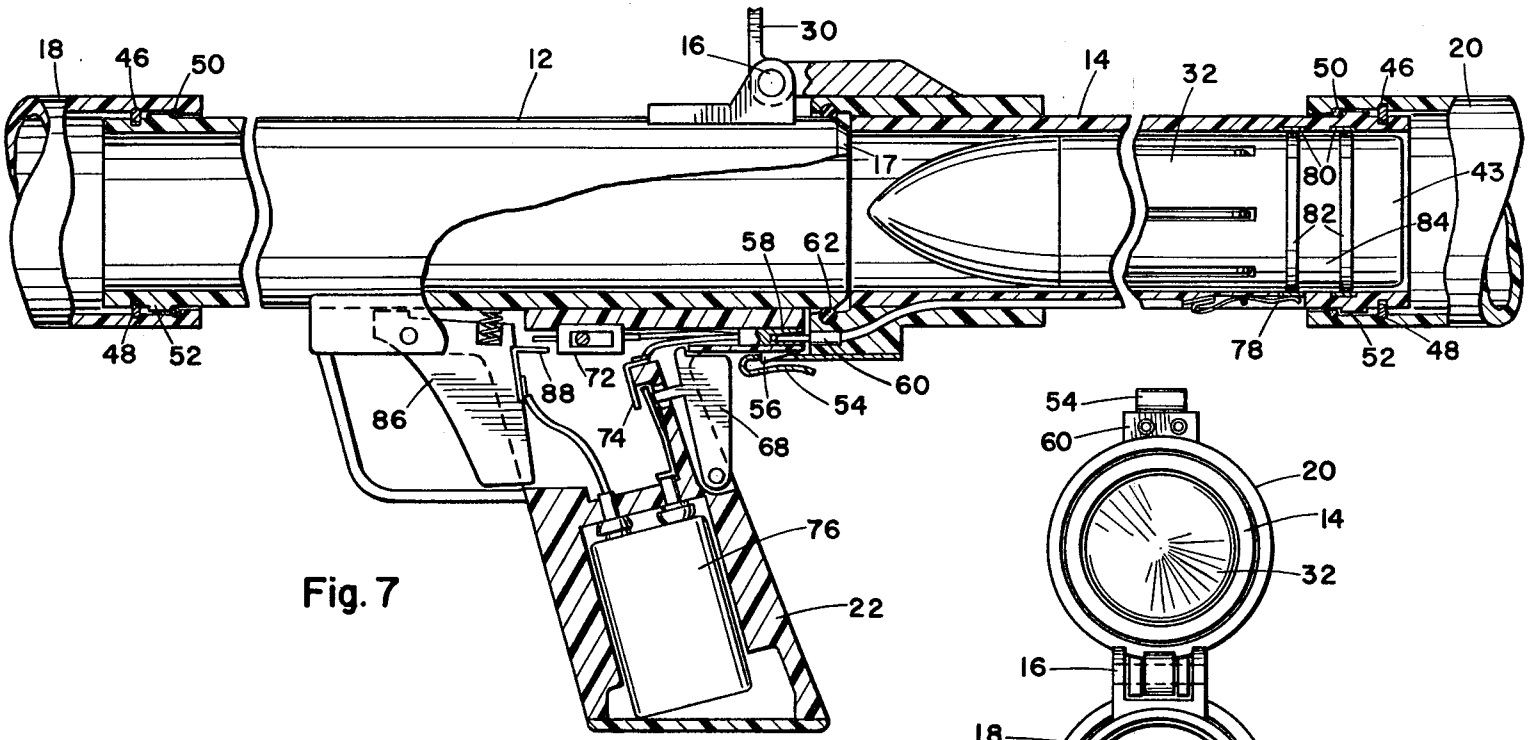
FIG. 7 is a side elevation view, partially cut away, of the extended rocket launcher.

In FIG. 6, coupling hinge 16 and coupling latch 54 are illustrated as they appear in the folded configuration of rocket launcher 10. When the after launch tube section 14 is rotated to extend the launcher 10, latch 54 engages coupling hasp 56 to secure the tube sections 12 and 14 together. In the same coupling action, firing circuit receptacle 58 and firing circuit plug 60 are connected to complete the firing circuit to the after launch tube section 14 as illustrated in FIG. 7. Coupling "O" ring 62 seats over the after end 17 of tube section 12 to provide a gas tight seal between the launch tube sections 12 and 14 when the latch 54 and the hasp 56 are engaged.

Figure 8:
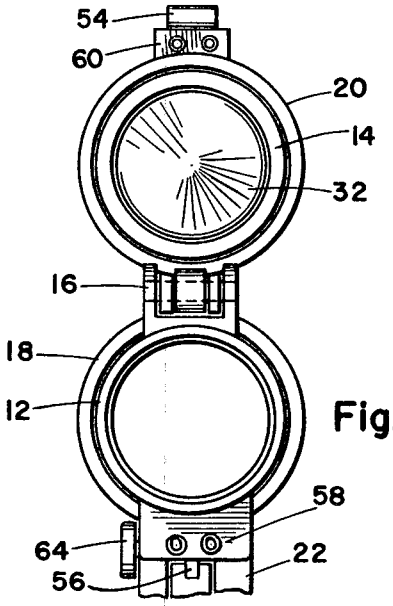
FIG. 8 is an end elevation view of the after end of the rocket launcher in the folded condition of FIG. 6.

The rocket 32 is fired electrically from the launcher 10. The construction and arrangement of the firing circuit is illustrated in FIGS. 7 and 8. Safety button 64 located in pistol grip 22 controls switch 72 of the firing circuit. Grip safety lever 68 similarly controls switch 74 of the firing circuit. Both switches 72 and 74 must be closed in order to complete the firing circuit powered by the battery 76 which is contained within pistol grip 22. An additional safety element in the circuit is provided by the after blast shield safety switch 78, which is closed when the blast shield 20 is fully extended from the after launch tube section 14.

As further illustrated in FIGS. 7 and 8, the firing circuit is connected to the rocket 32 through the electrical coupling 80 located at the after end of the launch tube section 14 which engages with the electrical connectors 82 located on the skirt of the rocket motor exit cone 84. Operation of trigger 86 closes firing switch 88 to initiate rocket ignition if safety switches 72, 74, and 78 are closed preparatory to firing.

OPERATION

Assuming that the launcher 10 is holster stowed as illustrated in FIG. 5 and contains a loaded round, the firing of the rocket from the launcher 10 can be described with reference to FIGS. 2 and 6. After withdrawing the launcher 10 from the holster 40, and removing caps 26, the launcher is extended by rotating the after launch tube section 14 about hinge 16, and coupling tube sections 12 and 14 together with latch 54 and hasp 56. The forward and after blast shields 18 and 20 are then fully extended from launch tube sections 12 and 14 respectively, and the sights 28 and 32 are raised. Handgrip 24 is rotated to its locked position. The launcher 10 may then be aimed as a shoulder fired weapon. To fire the rocket, the safety 64 is moved to the off position, and the trigger 86 squeezed while simultaneously depressing grip safety lever 68. A reload is accomplished by sliding the after blast shield 20 forward on after launch tube section 14 so that a new rocket round 32 may be inserted in the after end of launch tube section 14. The firing circuit is interrupted by the movement of blast shield 20 until it is again fully extended. With the reload completed and the after blast shield 20 again extended, the launcher is ready for firing.

Having described my invention, I claim:

1. A man portable rocket weapon system, comprising:

rocket means for use in said weapon system, a first and second launch tube section connectable to each other at one end and foldable one upon the other for compact storage, coupling means for unfolding and joining the launch tube sections in line with one another to form an extended rigid launching tube, blast protection means mountable upon the launch tube sections, grip means mountable upon the first launch tube section for holding the launching tube, firing means mountable on the first launch tube section for firing the rocket means from the launching tube, safety means in operative relationship with the firing means and the launching tube for firing the rocket means in an established sequence, means for carrying the folded tube sections and rocket means on a waist belt.

2. A man portable rocket weapon system as recited in claim 1 wherein the coupling means includes:

hinge means connecting the ends of the launch tube sections for rotatably positioning the launch tube sections in line with one another, locking means for securing the in line launch tube sections together, means for establishing a gas tight seal between the launch tube sections as they are secured together by the locking means.

3. A man portable rocket weapon system as recited in claim 2 wherein the blast protection means includes:

tubular blast shields concentrically mountable on the launch tube sections and extendable longitudinally therefrom, and seal means for establishing a gas tight connection between the extended blast shields and the launch tube sections upon which they are mounted.

4. A man portable rocket weapon system as recited in claim 3 wherein:

the rocket means is storable in the second launch tube section as a ready round.

5. A man portable rocket weapon system as recited in claim 4 wherein the firing means includes:

battery means supportable in the grip means for supplying electrical power to the firing means, circuit means for conducting the flow of electrical power from the battery means to the stored rocket means, switch means for controlling the flow of electrical power in the circuit means, connector means within the circuit means for interrupting the circuit means between the launch tube sections until the coupling means locks the launch tube sections in line.

6. A man portable rocket weapon system as recited in claim 5 wherein the safety means includes:

an interlock switch in the firing means to prevent the flow of electrical power to the rocket means unless the blast shield mountable on the second launch tube is fully extended.

7. A man portable rocket weapon system as recited in claim 6 wherein the rocket means includes:

a rocket motor casing for housing a solid propellant, longitudinal slots in the motor casing, stabilizing fins rotatably mountable in the slots in the motor casing when the rocket means is loaded in the launch tube section, and spring means within the slots for rotatably extending the fins from the slots when the rocket means is launched.

8. A man portable rocket weapon system as recited in claim 7 wherein:

the launching tube is reloadable.

* * * * *